8-107 SR
6/17/86 XR 4,595,394

United States Patent [19]

Okamoto et al.

[11] Patent Number: 4,595,394

[45] Date of Patent: Jun. 17, 1986

[54] AGENT FOR IMPROVING PROCESSABILITY OF CELLULOSE FIBERS: ACID POLYMER SALTS FOR IMPROVED SCOURING

[75] Inventors: Masakatsu Okamoto; Shigeru Nagao; Kazuhisa Yagi, all of Wakayama, Japan

[73] Assignee: Kao Corporation, Tokyo, Japan

[21] Appl. No.: 595,792

[22] Filed: Apr. 2, 1984

[30] Foreign Application Priority Data

| | | | |
|---|---|---|---|
| Apr. 8, 1983 | [JP] | Japan | 58-61952 |
| Apr. 11, 1983 | [JP] | Japan | 58-63466 |
| May 12, 1983 | [JP] | Japan | 58-83426 |
| May 12, 1983 | [JP] | Japan | 58-83427 |
| May 23, 1983 | [JP] | Japan | 58-90371 |
| May 23, 1983 | [JP] | Japan | 58-90372 |
| Jan. 6, 1984 | [JP] | Japan | 59-573 |
| Jan. 6, 1984 | [JP] | Japan | 59-574 |
| Jan. 6, 1984 | [JP] | Japan | 59-575 |
| Jan. 19, 1984 | [JP] | Japan | 59-7859 |
| Jan. 19, 1984 | [JP] | Japan | 59-7860 |
| Jan. 19, 1984 | [JP] | Japan | 59-7861 |
| Jan. 26, 1984 | [JP] | Japan | 59-12710 |

[51] Int. Cl.[4] ..... D06P 5/22; C11D 7/54; D06L 3/02

[52] U.S. Cl. ..... 8/139; 8/101; 8/107; 8/115.6; 8/137; 8/918

[58] Field of Search ..... 8/558, 116, 107, 137, 8/139

[56] References Cited

U.S. PATENT DOCUMENTS

| | | | |
|---|---|---|---|
| 3,148,019 | 9/1964 | Gallagher et al. | 8/139 |
| 3,281,202 | 10/1966 | Helmick et al. | 8/139 |
| 3,308,067 | 3/1967 | Diehl | 252/550 |
| 3,719,647 | 3/1973 | Hardy et al. | 526/240 |
| 4,036,587 | 7/1977 | Wolf et al. | 8/558 |
| 4,095,942 | 6/1978 | Dellian et al. | 8/558 |
| 4,231,745 | 11/1980 | Feess et al. | 8/552 |
| 4,297,100 | 10/1981 | Koci et al. | 8/527 |
| 4,312,634 | 1/1982 | Katz | 8/139 |
| 4,330,293 | 5/1982 | Lindemann | 8/495 |

FOREIGN PATENT DOCUMENTS

| | | |
|---|---|---|
| 76992 | 4/1983 | European Pat. Off. . |
| 3305637 | 8/1984 | Fed. Rep. of Germany . |

*Primary Examiner*—A. Lionel Clingman
*Attorney, Agent, or Firm*—Flynn, Thiel, Boutell & Tanis

[57] ABSTRACT

A fiber processability-improving agent comprising a salt of (meth-)acrylic acid and/or maleic acid (co-)polymer is provided. This agent has an average molecular weight of up to 10,000 and is useful for improving dyeability and scouring properties of fibers to realize a level dyeing and an excellent hand.

7 Claims, No Drawings

AGENT FOR IMPROVING PROCESSABILITY OF CELLULOSE FIBERS: ACID POLYMER SALTS FOR IMPROVED SCOURING

BACKGROUND OF THE INVENTION

The present invention relates to an agent for improving processability of fibers. Generally, fibers are subjected to various treatments such as scouring, bleaching and dyeing to enhance commercial value thereof until they are processed into the final fibrous products. Various chemicals and dyes are used in the treatments. However, impurities contained in the fibers per se, impurities incorporated therein in the preceding steps and ions contained in hard water pose problems of inhibiting penetration of the chemicals into the fibers to cause a non-level finish and a rough hand. The present invention provides an agent for effecting the treatment of the fibers smoothly to obtain excellent results, i.e. an agent for improving processability of fibers.

Cellulose fibers have been scoured with an alkali, surfactant and solvent in the prior art. Particularly, a combination of an alkali with a surfactant has been employed widely. The cellulose fibers have been scoured for the purpose of removing water-repellent substances, i.e. primary impurities (natural impurities) such as greases and waxes and secondary impurities (additional impurities) such as machine oils from the fibers to impart wettability and water-absorbing properties to the fibers so that the penetration of the chemicals is facilitated and the operation is made easy in the subsequent steps of bleaching, dyeing and finishing the fibers. Thus, by this preliminary treatment, the commercial value of the product can be raised and the characteristic properties of the fibers can be exhibited. However, the scouring process wherein the combination of an alkali and a surfactant is used has problems to be solved as will be described below.

When water having a high hardness is used in the scouring, water-hardening components are bonded with fatty acids formed by the hydrolysis of the grease with the alkali to form a metallic soap. The metallic soap thus formed is deposited on the fibers to be scoured. The metallic soap which cannot be easily emulsified or dispersed by an ordinary scouring surfactant remains on the fibers still after completion of the scouring to make the fibers water-repellent. Consequently, the wettability and water-absorbing property required of the fibers are damaged and the chemicals cannot penetrate therein in the subsequent bleaching, dyeing and finishing steps to pose the problems. To solve these problems, ethylenediaminetetraacetic acid, diethylenetriaminepentaacetic acid, hydroxyethylenediaminetriacetic acid, nitrilotriacetic acid or sodium tripolyphosphate has been used but the effects of them are not always sufficient. Thus, no satisfactory measure has been developed as yet.

Silk fibers comprise generally fibroin and sericin surrounding the fibroin. To realize the essential properties of silk, it is necessary to remove sericin. Sericin has been removed by the scouring with a surfactant and an alkali. However, this process has problems to be solved as will be described below.

When water having a high hardness is used in the scouring of silk, ions in the hard water are bonded with a soap used as the surfactant to form a metallic soap which is difficultly soluble in water. The metallic soap is deposited on the silk fiber. Further, the ions in the hard water are bonded also with, for example, sodium silicate used as the alkali to form water-insoluble silicates, which are deposited on the silk fibers to worsen the hand thereof or to make the penetration of the chemicals difficult in the subsequent dyeing and finishing steps. Problems are thus caused. The scouring time of the silk is elongated by the soap to damage the silk fibers. To solve these problems, there has been used ethylenediaminetetraacetic acid, diethylenetriaminepentaacetic acid, hydroxyethylenediaminetriacetic acid, nitrilotriacetic acid or sodium tripolyphosphate but the effects of them are not always sufficient. Thus, no satisfactory measure has been developed yet.

Textiles of regenerated fibers such as rayon and cuprammonium rayon, semisynthetic fibers such as diacetate and triacetate fibers and synthetic fibers such as polyester, nylon and acrylic fibers contain secondary impurities such as a spinning oil, a sizing agent used for facilitating the twisting and weaving, a spin finish and dirts, although they do not contain the primary impurities that are present in natural cellulose fibers. These impurities must be removed completely or uniformly, since they worsen the hand of the fibers and inhibit the penetration of a dyeing liquid and resin solution in the dyeing and finishing steps to cause an unlevel dyeing or unlevel resin finish. The sizing agents include natural starch sizing agents such as potato starch and wheat starch sizing agents and synthetic sizing agents such as polyvinyl alcohol, acrylic acid polymers and vinyl acetate copolymers. Among them, the synthetic sizing agents, particularly, the acrylic acid polymers, have been used widely, since the natural starch sizing agents generally have an incomplete adhesion and they cannot be removed easily. To remove the impurities such as the spinning oil, sizing agent, lubricant and dirts, the scouring is effected generally using a surfactant and an alkali such as sodium hydroxide. However, this process has problems to be solved as will be described below.

When water having a high hardness is used in the scouring, components of the hard water are bonded with fatty acids formed by the hydrolysis of oil components in the lubricant with the alkali to form a water-insoluble metallic soap. The metallic soap thus formed is deposited on the fibers to be scoured. The metallic soap which cannot be easily emulsified or dispersed by an ordinary surfactant used in the scouring remains on the fibers after completion of the scouring. Consequently, the hand of the treated fibers becomes rough and the chemicals cannot easily penetrate therein in the subsequent dyeing and finishing steps to cause problems. Further, the acrylic acid polymers used as the synthetic sizing agent are bonded with the components of the hard water to form a water-insoluble sizing agent, which is deposited again on the fibers to be scoured to pose the same problems as described above. To solve these problems, there has been used ethylenediaminetetraacetic acid, diethylenetriaminepentaacetic acid, hydroxyethylenediaminetriacetic acid, nitrilotriacetic acid and sodium tripolyphosphate but their effects are not always sufficient. Thus, no satisfactory measure has been developed yet.

A specific phenomenon of polyester fibers has been known that they are hydrolyzed with a hot alkali solution and the surfaces are gradually dissolved to make the fibers thin. When textiles or knittings of the polyester fibers are subjected to this treatment, the gaps in the fibers are increased to make the textiles or knittings bulky, to loosen and soften the fibers and to realize a so-called silky hand. Though the polyester fibers are subjected to the alkali treatment frequently before the dyeing treatment, this process has problems as will be described below.

When water having a high hardness is used in the weight reduction with the alkali, components of the hard water are bonded with polyester oligomers formed in this treatment to form water-insoluble salts. The formed salts are deposited on the fibers to worsen the hand and to make the penetration of chemicals difficult in the subsequent steps. These defects are observed also in washing steps before and after a neutralization step following the step of weight reduction with alkali. To solve these problems, there have been used ethylenediaminetetraacetic acid, diethylenetriaminepentaacetic acid, hydroxyethylenediaminetriacetic acid, nitrilotriacetic acid and sodium tripolyphosphate but their effects are yet insufficient. Thus, no satisfactory measure has been developed as yet.

The cellulose fibers are bleached generally after the scouring to remove natural colorants remaining in the fibers and colorants attached thereto afterwards. The bleaching has been effected with a peroxide, chlorine or sodium chlorite. Among them, the peroxides have been employed widely in general, since they do not damage the fibers and durable whiteness can be realized by an easy operation. In the peroxide bleaching, colorants contained in the cellulose fibers are decomposed by oxidation with nascent oxygen formed by a decomposition of hydrogen peroxide. The oxidative decomposition is effected in the presence of an alkali such as sodium hydroxide, since a high efficiency can be obtained under alkaline conditions. Further, sodium silicate is used as a stabilizing agent in the hydrogen peroxide decomposition under the alkaline conditions. Therefore, the bleaching bath comprises hydrogen peroxide, an alkali (such as sodium hydroxide) and sodium silicate (having an $SiO_2/Na_2O$ molar ratio of 2.5/1). When water having a high hardness is used in the bleaching, components of the hard water are bonded with sodium silicate to form water-insoluble silicates such as calcium silicate and magnesium silicate, which are deposited on the fibers. Consequently, the whiteness of the cloth cannot be improved, its hand is worsened and the coefficient of friction with a needle of a sewing machine is increased to cause troubles in the sewing. It has been demanded to overcome these defects. To solve these problems, there have been used ethylenediaminetetraacetic acid, diethylenetriaminepentaacetic acid, hydroxyethylenediaminetriacetic acid, nitrilotriacetic acid and sodium tripolyphosphate. However, their effects are still insufficient. Thus, no satisfactory measure has been developed yet.

Cellulose fibers are generally dyed with direct dyes, sulfide dyes, threne dyes, naphthol dyes, reactive dyes, basic dyes and acid dyes. These dyes have characteristic properties. Namely, the direct dyes dye fibers by physicochemical adsorption and the color fastness can be increased easily by a fixing treatment effected after the dyeing. The sulfide dyes exhibit an excellent color fastness (dyeing fastness) but the realized color has only a poor vividness. The threne dyes exhibit a quite excellent dyeing fastness. The naphthol dyes require complicated steps such as penetration of a grounder into the fiber and the development by diazotizing a developer, though they exhibit a relatively vivid color tone and a good dyeing fastness. The reactive dyes dye fibers by forming covalent bonds between the dye and the fibers to exhibit an excellent vividness and dyeing fastness. The basic dyes require a complicated mordanting step and exhibit a low dyeing fastness. The acid dyes require a complicated dyeing process and the resulting hue is unstable. Therefore, the direct dyes, threne dyes and reactive dyes have mainly been used among them. The direct dyes include various dyes, mainly metal-containing azo dyes. These metal-containing compounds are contained frequently also in the acid dyes and the reactive dyes. The metal-containing dyes comprise a metal atom such as chromium, copper, cobalt, iron or aluminum coordinated with a colorant molecule. However, in the dyeing with such dyes, problems which will be described below have been posed and the solution thereof has been demanded. When water having a high hardness is used, the components of the water inhibit the solubilization or dispersion of the dye to make the level dyeing impossible. For solving this problem, a chelating agent such as ethylenediaminetetraacetic acid, diethylenetriaminepentaacetic acid, hydroxyethylenediaminetriacetic acid or nitrilotriacetic acid has been used. Though the chelating agent captures the water-hardening components to some extent to exhibit a slight level-dyeing effect, the effect is still poor. In addition, the chelating agent forms a complex salt with the metal contained in the dye as the developing group. Consequently, the balance of the coordination between the dye and the metal is broken and the hue of the dyed cloth is far deviated from the intended hue. This is a fatal defect. The threne dyes which are important dyes in dyeing the cellulose fibers are water-insoluble dyes having two or more carbonyl groups. In dyeing with this dye, it is reduced with an alkali to convert the carbonyl groups into a leuco sodium salt which is water-soluble and has a high affinity with the cellulose fibers. After the dyeing with this dye, the leuco sodium salt is oxidized with an acid to form a quinone compound. Thus, the color development and water-insolubilization can be effected simultaneously. This process also has the following problem to be solved: when water having a high hardness is used in the dyeing, water-hardening components in the water used are bonded with the dye to form a dye dimer having no solubility in water nor affinity with the cellulose fibers. Therefore, a color depth expected from a dye concentration used cannot be obtained. For solving this problem, a chelating agent such as ethylenediaminetetraacetic acid, diethylenetriaminepentaacetic acid, hydroxyethylenediaminetriacetic acid or nitrilotriacetic acid has been used. However, their effects have been yet insufficient. Thus, no satisfactory measure has been developed as yet.

Generally, natural fibers such as silk and wool, regenerated fibers such as rayon and cuprammonium rayon, semisynthetic fibers such as cellulose diacetate and triacetate fibers and synthetic fibers such as polyester, nylon and acrylic fibers are dyed for the purpose of enhancing the commercial value and fashionability of the fibers.

The dyeing can be effected by various processes. For example, a dip dyeing in a batch system is effected by immersing a material to be dyed such as fiber, thread, textile, knitting, non-woven cloth or fibrous product in a dye bath to adsorb the dye on the material while the temperature and time are controlled. Various methods have been proposed for effecting the level dyeing in this process. For example, a dyeing assistant selected depending on the fiber and the dye is added to the dye bath. However, in this process, the dye is coagulated or precipitated in the dye bath to make the level dyeing impossible due to tarring or dyeing specks under some dyeing conditions or when water having a high hardness is used even when a levelling agent having a high dispersibility is used or even when a dispersing agent in addition to another dispersing agent contained already in the dye is used. A reduction clearing technique has been employed for improving the dyeing fastnesses by removing the non-fixed moiety of the dye. However, even when a dyeing assistant such as a levelling agent or dispersing agent is used in the dyeing, a considerable amount of the non-fixed dye remains on the surface of the fiber to reduce the reduction clearing properties. For solving this problem, an additive such as ethylenediaminetetraacetic acid, diethylenetriaminepentaacetic acid, hydroxyethylenediaminetriacetic acid, nitrilotriacetic acid or sodium tripolyphosphate is added to the dye bath. However, their effects have been yet insufficient. Thus, no drastic measure has been developed as yet.

In a continuous dyeing process such as a thermosol dyeing process or padding/steaming dyeing process, a material to be dyed such as textile, knitting or non-woven fabric is treated with a dye solution to effect the padding and then the color is developed by dry heating or steaming treatment. For effecting the level dyeing or increasing the utilization of the dye, a sizing agent and a dispersing agent selected suitably depending on the fibrous material and the dye are added to the dye bath. Under some dyeing conditions or when water having a high hardness is used, the dye is coagulated or precipitated to cause migration even in the presence of the dispersing agent or sizing agent. As a result, the level dyeing becomes impossible due to dyeing specks, etc. Some sizing agents are bonded with the hardening component contained in water to form an insoluble sizing agent which cannot be removed completely in a washing (desizing) step following the dyeing step. The similar problems, i.e. non-level dyeing and poor desizing effect, are posed also in a printing process such as direct printing, colored discharge or resist printing, or white discharge or resist printing wherein a sizing agent is used. To solve these problems, an additive such as ethylenediaminetetraacetic acid, diethylenetriaminepentaacetic acid, hydroxyethylenediaminetriacetic acid, nitrilotriacetic acid or sodium tripolyphosphate has been added to the dye bath. However, their effects have been yet insufficient. Thus, no satisfactory measure has been developed as yet.

After intensive investigations made for the purpose of solving the problems posed in processing the fibers, the inventors have found that the processability can be improved by using a specified compound. The present invention has been completed on the basis of this finding.

SUMMARY OF THE INVENTION

An object of the present invention is to provide a fiber processability-improving agent comprising a salt of (meth)acrylic acid and/or maleic acid (co)polymer having an average molecular weight of up to 10,000.

DETAILED DESCRIPTION OF THE EMBODIMENTS

An important condition of the invention is that the monomer(s) constituting the (co)polymer salt of the present invention is(are) acrylic acid (or methacrylic acid) and/or maleic acid and the salt has a molecular weight of up to 10,000. The lower limit of the molecular weight is 200. As a matter of course, various other monomers may be used as a third component, unless the effects of the invention are damaged.

Now, the description will be made on typical examples of the (co)polymer salts according to the present invention.

Salts of acrylic or methacrylic acid polymers having an average molecular weight of 1,000 to 8,000:

The salts of acrylic or methacrylic acid polymers include alkali metal salts such as sodium salt and potassium salt, ammonium salt and alkanolamine salt such as diethanolamine and triethanolamine salts. The polymers may be copolymers containing second components which do not damage the properties. The second components include acrylamide, sulfonic acids such as methacrylsulfonic acid and vinylsulfonic acid, 2-hydroxyethyl acrylate, acrylic esters, methacrylic esters, N-methylolacrylamide and other copolymerizable compounds.

Salts of maleic acid polymers having an average molecular weight of 200 to 10,000:

These polymer salts have a molecular weight of 200 to 10,000, preferably 300 to 8,000 and particularly 300 to 5,000. With a higher or lower molecular weight, the effects of the polymers are reduced. The maleic acid polymer salts according to the present invention can be obtained easily by polymerizing maleic anhydride followed by ring-opening neutralization or by polymerizing maleic acid (salt). The usable maleic acid polymer salts include alkali metal and ammonium salts as well as alkanolamine salts such as diethanolamine and triethanolamine salts. The polymers may be copolymers containing second components which do not damage the properties of the polymers. The second components include acrylamide, sulfonic acids such as methacrylsulfonic acid and vinylsulfonic acid, 2-hydroxyethyl acrylate, acrylic esters, methacrylic esters, N-methylolacrylamide and other copolymerizable compounds.

Further, copolymers of them with polyoxyalkylene monoallyl ethers of the general formula:

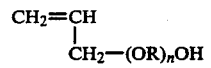

wherein OR represents an oxyalkylene group having 2 or 3 carbon atoms and n represents an integer of 1 to 50 may also be used.

copolymer salts containing maleic acid (MA) and acrylic or methacrylic acid (AA) as indispensable monomeric constituents in a molar ratio (MA/AA=r) of 0.1 to 2.7 and having an average molecular weight (MW) of 1,000 to 8,000:

Among these copolymer salts, those having r of 1.15 to 2.7, MW of 1,000 to 8,000 and r x MW of at least 3,000 exhibit the maximum effects. These salts are obtained preferably by copolymerizing (meth)acrylic acid with maleic acid in a molar ratio of 1/1.2 to 3.0 in the presence of a polymerization initiator in an aqueous solution kept at pH 3.5 to 5.0 with an alkali metal hydroxide and then neutralizing the product. Other preparation processes may also be employed.

The copolymer salts comprising maleic acid and (meth)acrylic acid as indispensable monomeric constituents include alkali metal and ammonium salts as well as alkanolamine salts such as diethanolamine salts and triethanolamine salts. The copolymers comprising maleic acid and (meth)acrylic acid as indispensable monomeric constituents may contain a non-neutralized moiety to some extent unless their abilities are adversely affected thereby.

The copolymers may contain a third component in addition to maleic acid and (meth)acrylic acid unless their abilities are adversely affected thereby. The third components include acrylamide, sulfonic acids such as methacrylsulfonic acid and vinylsulfonic acid, 2-hydroxyethyl acrylate, acrylic esters, methacrylic esters, N-methylolacrylamide and other copolymerizable compounds.

The use of the fiber processability-improving agent of the present invention in a step of processing the fiber brings about a desirable result not only in this step but also in the subsequent treatment steps.

When the cellulose fibers are scoured with an alkali, a surfactant and the scouring property-improving agent of the present invention, the treated fibers have wettability and water-absorption properties higher than those of fibers treated by conventional scouring processes. Further, in the subsequent bleaching, dyeing and finishing steps, the chemicals can penetrate therein uniformly to make the operation easy. Though the mechanism by which the problems in the scouring of the cellulose fibers using the (co)polymer of the invention in combination with the alkali and the surfactant can be solved has not been fully elucidated as yet, it is supposed connected with quite excellent sequestering capacity and dispersing power of the (co)polymer salt of the invention.

The scouring may be effected by conventional methods such as padding/steaming, pressure boiling, boiling, immersion at about 60° to 100° C., or the like. The scouring property-improving agent of the invention may be used when the scouring is effected in a desizing step preceding the scouring step, or in a bleaching step following the scouring step, unless the scouring property is damaged, so as to rationalize the process.

The amount of the processability-improving agent of the present invention which varies depending on the amount of a scouring agent, etc. is generally 0.01 to 20 g (as solid) and preferably 0.04 to 10 g per liter of the scouring bath.

When the fiber processability-improving agent of the invention is used in the treatments such as scouring of silk and other fibers and reduction in weight of polyester fibers with an alkali effected prior to a dyeing step, effects superior to those of conventional processes and an excellent hand can be obtained. In addition, the uniform penetration of chemicals can be effected in the subsequent dyeing and finishing steps to facilitate the operations. Though the mechanism by which the problems can be solved with the aid of the processability-improving agent of the invention comprising the (co)polymer salt in the scouring of silk and other fibers and in the reduction in weight of polyester fibers with alkali has not been fully elucidated as yet, it is believed to be connected with the excellent sequestering capacity and dispersing power of the (co)polymer salt of the invention.

When the cellulose fibers are bleached with hydrogen peroxide, an alkali, sodium silicate and the processability-improving agent of the invention, a whiteness, hand and sewing property superior to those of the conventional bleaching processes can be obtained. Though the mechanism by which the problem of poor bleaching effects can be solved with the aid of the processability-improving agent of the invention comprising the (co)polymer in combination with hydrogen peroxide, an alkali and sodium silicate in bleaching the cellulose fibers has not fully been elucidated as yet, it is believed to be connected with excellent sequestering capacity and dispersing power of the (co)polymer salt of the invention.

The amount of the processability-improving agent of the present invention which varies depending on the amount of a bleaching agent, etc. is generally 0.01 to 20 g (as solid) and preferably 0.04 to 10 g (as solid) per liter of the bleaching bath.

When the cellulose fiber is dyed with a metal-containing dye or threne dye using water having a high hardness, an excellent dyeability superior to that obtained by a conventional dyeing process can be obtained by effecting the dyeing in the presence of the processability-improving agent of the invention. Though the mechanism by which the problems can be solved with the aid of the processability-improving agent of the invention comprising the (co)polymer salt in the dyeing of the cellulose fibers with a metal-containing dye has not been fully elucidated as yet, it is supposed that the quite excellent sequestering capacity and dispersing power of the processability-improving agent act only on the water-hardening components in water and not on the metal (chromophoric group in the dye) and, therefore, the balance between the coordinated dye and the metal is not broken. Accordingly, the level dyeing can be realized without hue deviation of the dyed fiber from an intended hue. Though the mechanism by which the problems can be solved with the aid of the processability-improving agent of the invention comprising the (co)polymer salt in the dyeing of the cellulose fibers with a threne dye has also not been fully elucidated as yet, it is believed to be connected with the excellent sequestering capacity and dispersing power of the (co)polymer salt of the invention.

The amount of the processability-improving agent of the present invention which varies depending on the amount and concentration of the dye used is generally 0.01 to 20 g (as solid), preferably 0.04 to 10 g (as solid) per liter of the dye bath.

The processability-improving agent of the present invention is effective also in dyeing fibers other than the cellulose fibers.

When the processability-improving agent of the invention is used in dip dyeing, continuous dyeing or printing process, the above-mentioned various problems can be solved and defects such as tarring and dyeing specks can be overcome to obtain an excellent dyeability. Further, the reduction clearing and desizing treatment per se are facilitated and the treating capacities can be increased. Though the mechanism of these effects has not been fully elucidated, it is believed to be connected with the excellent sequestering capacity and dispersing power of the (co)polymer salt of the invention.

The amount of the processability-improving agent of the invention used for this purpose is the same as that used in the dyeing of the cellulose fibers.

The dye bath may contain also other additives such as a softening agent, scouring agent and penetrate unless the processability-improving effects of the invention are adversely affected thereby. The fibers for which the processability-improving agent of the present invention can be used are not particularly limited. They include natural fibers such as cellulose fibers, wool and silk and various synthetic fibers.

The processability-improving agent of the present invention may be used in the treatment of cellulose fibers such as cotton and hemp fibers; regenerated fibers such as rayon and cuprammonium fibers; semisynthetic fibers such as cellulose diacetate and triacetate fibers; synthetic fibers such as nylon, polyester and acrylic fibers; and mixtures of them. The form of the fibers to be processed may be any of fiber, thread, hank, textile, knitting, non-woven fabric and sometimes clothes and bedclothes.

The following examples and preparation examples will further illustrate the present invention, which by no means limit the invention.

PREPARATION EXAMPLE 1

670 g of ion-exchanged water was charged in a 2 l four-necked flask provided with a stirrer, condenser, thermometer, $N_2$ gas inlet tube and dropping funnel and the temperature was elevated to 100° C. Then, 560 g of 80% acrylic acid, 492 g of 48% aqueous sodium hydroxide solution, 74 g of 30% ammonium persulfate and 132.8 g of 35% hydrogen peroxide were added dropwise simultaneously thereto over 4 h. After completion of the addition, the mixture was aged at 100° C. for 1 h to obtain a dyeability-improving agent comprising sodium polyacrylate. The molecular weight of the product determined according to GPC was about 5,000.

PREPARATION EXAMPLE 2

1200 g of 20% aqueous isopropyl alcohol solution was charged in the same flask as in Preparation Example 1 and the temperature was elevated to 80° C. Then, 224 g of 98% acrylic acid and 71 g of 10% aqueous ammonium persulfate solution were added dropwise thereto simultaneously over 2 h. After completion of the addition, the mixture was aged at 80° C. for 1 h. Then, isopropyl alcohol was removed and the residue was neutralized with 246 g of 48% aqueous sodium hydroxide solution to obtain a dyeability-improving agent comprising sodium polyacrylate. The molecular weight of the product determined according to GPC was about 3,000.

PREPARATION EXAMPLE 3

200 g of ion-exchanged water was charged in the same flask as in Preparation Example 1 and the temperature was elevated to 100° C. Then, 547 g of 80% acrylic acid, 47.4 g of 2-mercaptoethanol and 122.5 g of 4% aqueous potassium persulfate solution were added simultaneously and dropwise thereto over 2 h. After completion of the addition, the mixture was aged at 100° C. for 1 h. Then, the mixture was neutralized with 506.1 g of 48% aqueous sodium hydroxide solution to obtain a dyeability-improving agent comprising sodium polyacrylate. The molecular weight of the product determined according to GPC was about 2,000.

PREPARATION EXAMPLE 4

The polyacrylic acid obtained in Preparation Example 2 was neutralized with 179 g of 28% aqueous ammonia in place of sodium hydroxide to obtain a dyeability-improving agent comprising ammonium polyacrylate having a molecular weight of about 3,000.

PREPARATION EXAMPLE 5

The polyacrylic acid obtained in Preparation Example 2 was neutralized with 880 g of 50% aqueous triethanolamine solution in place of sodium hydroxide to obtain a dyeability-improving agent comprising polyacrylic acid triethanolamine having a molecular weight of about 3,000.

PREPARATION EXAMPLE 6

An aqueous solution of sodium maleate was prepared by neutralizing maleic anhydride with an aqueous sodium hydroxide solution in a four-necked flask. The aqueous solution polymerization of this product was effected in the presence of ammonium persulfate at 100° C. for 5 h to obtain a dyeability-improving agent comprising sodium polymaleate having a molecular weight of 3,000.

PREPARATION EXAMPLE 7

An aqueous solution of sodium maleate was prepared by neutralizing maleic anhydride with an aqueous sodium hydroxide solution in a four-necked flask. The aqueous solution polymerization of this product was effected in the presence of ammonium persulfate and hydrogen peroxide at 100° C. for 6 h to obtain a dyeability-improving agent comprising sodium polymaleate having a molecular weight of 1,000.

PREPARATION EXAMPLE 8

An aqueous solution of sodium maleate was prepared by neutralizing maleic anhydride with an aqueous sodium hydroxide solution in a four-necked flask. The aqueous solution polymerization of this product was effected in the presence of ammonium persulfate and hydrogen peroxide at 100° C. for 5 h to obtain a dyeability-improving agent comprising sodium polymaleate having a molecular weight of 700.

PREPARATION EXAMPLE 9

An aqueous solution of sodium maleate was prepared by neutralizing maleic anhydride with an aqueous sodium hydroxide solution in a four-necked flask. The aqueous solution polymerization of this product and acrylamide was effected in the presence of hydrogen peroxide at 100° C. for 6 h to obtain a dyeability-improving agent comprising sodium polymaleate containing 3% of acrylamide as a second component. The molecular weight was 4,000.

PREPARATION EXAMPLE 10

A solution of maleic anhydride in toluene was polymerized in the presence of benzoyl peroxide at 90° C., for 8 h in a four-necked flask. Then, toluene was distilled off. The residue was neutralized with aqueous ammonia to obtain a dyeability-improving agent comprising ammonium polymaleate having a molecular weight of 2,000.

PREPARATION EXAMPLE 11

A dyeability-improving agent comprising triethanolamine salt of polymaleic acid was prepared in the same manner as in Preparation Example 10 except that an aqueous triethanolamine solution was used for the neutralization in place of the aqueous ammonia. The molecular weight was 2,000.

PREPARATION EXAMPLE 12

Water, 40% aqueous sodium hydroxide solution and a polyoxyalkylene monoallyl ether containing 10 ethylene oxide units on an average in the molecule were charged in a stainless steel autoclave. Nitrogen was introduced therein under stirring and the temperature was elevated to 90° C. Then, 70% aqueous t-butyl hydroperoxide solution as a polymerization initiator was introduced therein. The introduction of nitrogen was stopped, the autoclave was closed and the mixture was stirred at 120° C. for 5 h. Then, the temperature was lowered to below 50° C. 40% sodium hydroxide solution and water were added thereto to obtain a dyeability-improving agent comprising sodium salt of a copolymer of maleic acid (MA) and polyoxyalkylene monoallyl ether (POA). The POA/MA molar ratio was 20/100 and the average molecular weight was 1,100.

PREPARATION EXAMPLE 13

An aqueous sodium acrylate solution and an aqueous sodium maleate solution were prepared by neutralizing acrylic acid and maleic anhydride, respectively, with an aqueous sodium hydroxide solution. The aqueous solution polymerization of the two solutions was effected in the presence of ammonium persulfate at 100° C. for 5 h to obtain a dyeability-improving agent comprising sodium salt of the copolymer.

PREPARATION EXAMPLE 14

An aqueous sodium maleate solution was prepared by neutralizing maleic anhydride with an aqueous sodium hydroxide solution in a four-necked flask. The aqueous solution polymerization of the solution and an aqueous acrylic acid solution was effected in the presence of ammonium persulfate and hydrogen peroxide at 100° C. for 5 h. The resulting product was neutralized with an aqueous sodium hydroxide solution to obtain a dyeability-improving agent comprising sodium salt of the copolymer.

PREPARATION EXAMPLE 15

An aqueous sodium maleate solution was prepared by neutralizing maleic anhydride with an aqueous sodium hydroxide solution in a four-necked flask. The aqueous solution polymerization of this solution and an aqueous acrylic acid solution was effected in the presence of ammonium persulfate, hydrogen peroxide and sodium hydroxide at 100° C. for 6 h.

An aqueous sodium hydroxide solution was added thereto to neutralize the product. Thus, a dyeability-improving agent comprising sodium salt of the copolymer was obtained.

PREPARATION EXAMPLE 16

An aqueous sodium maleate solution was prepared by neutralizing maleic anhydride with an aqueous sodium hydroxide solution in a four-necked flask. The aqueous solution polymerization of this solution and an aqueous acrylic acid solution was effected in the presence of hydrogen peroxide and sodium hydroxide at 100° C. for 6 h. After neutralization with an aqueous sodium hydroxide solution, a dye-ability-improving agent comprising sodium salt of the copolymer was obtained.

PREPARATION EXAMPLE 17

An aqueous sodium maleate solution was prepared by neutralizing maleic anhydride with an aqueous sodium hydroxide solution in a four-necked flask. The aqueous solution polymerization of this solution, an aqueous acrylic acid solution and acrylamide was effected in the presence of hydrogen peroxide and sodium hydroxide at 100° C. for 6 h. After neutralization with an aqueous sodium hydroxide solution, a dyeability-improving agent comprising the salt of the copolymer and containing 3% of acrylamide as a third component was obtained.

PREPARATION EXAMPLE 18

A dyeability-improving agent was prepared in the same manner as in Preparation Example 16.

PREPARATION EXAMPLE 19

Maleic anhydride was copolymerized using a solution of acrylic acid in isopropyl alcohol in the presence of benzoyl peroxide at 90° C. for 8 h in a four-necked flask. Isopropyl alcohol was distilled off and the residue was neutralized with aqueous ammonia to obtain a dyeability-improving agent comprising ammonium salt of the copolymer.

PREPARATION EXAMPLE 20

A dyeability-improving agent comprising a triethanolamine salt of a copolymer was prepared in the same manner as in Preparation Example 19 except that an aqueous triethanolamine solution was used in place of aqueous ammonia.

The maleic acid/acrylic acid molar ratio (r), average molecular weight (MW), r×MW and the kind of the salt of each of the dyeability-improving agents obtained in Preparation Examples 13 to 20 are summarized in Table 1. MW was determined according to GPC (gel permeation chromatography). The value "r" was determined by measuring the amount of the total residual monomers (maleic acid and acrylic acid) by the bromine-bromide method, then determining the amount of remaining acrylic acid monomer by the bromide-bromate method and calculating the value "r" from them.

COMPARATIVE PREPARATION EXAMPLE

Polysodium acrylate having a molecular weight of 20,000 was obtained in the same manner as in Preparation Example 3 except that 4.74 g of 2-mercaptoethanol was used.

TABLE 1

| | r | MW | MW × r | Salt |
|---|---|---|---|---|
| Preparation Ex. 13 | 0.51 | 3000 | 1530 | sodium |
| Preparation Ex. 14 | 0.95 | 3000 | 2850 | " |
| Preparation Ex. 15 | 1.42 | 3000 | 4260 | " |
| Preparation Ex. 16 | 2.14 | 3000 | 6420 | " |
| Preparation Ex. 17 | 1.42 | 2500 | 3580 | " |
| Preparation Ex. 18 | 1.42 | 5000 | 7100 | " |
| Preparation Ex. 19 | 0.95 | 3000 | 2850 | ammonium |
| Preparation Ex. 20 | 0.95 | 3000 | 2850 | triethanolamine |

EXAMPLE 1

A polyester georgette crepe was dyed and then subjected to a reductive washing to examine its level-dyeing property and reduction clearing property and a dye-dispersibility in the dye solution. The results are shown in Tables 2 to 4.

Dyeing conditions:

| | |
|---|---|
| Hardness of water used | 30 DH |
| Dyes | Dianix Orange B-SE 3.0 owf (disperse dye of Mitsubishi Kasei Kogyo Co., Ltd.) Dianix Blue BG-SF 1.5% owf (disperse dye of Mitsubishi Kasei Kogyo Co., Ltd.) Miketon Polyester Red 4BF 1.5% owf (a disperse dye of Mitsui Toatsu Kagaku Co., Ltd.) |
| Levenol V-500 (levelling agent of Kao Sekken Co., Ltd.) | 0.5 g/l |
| Additives | see Tables 2 to 4 |
| pH | 4.5 (with acetic acid) |
| Bath ratio | 1/20 |
| Temperature | 130° C. |
| Time | 40 min |

Reduction clearing conditions:

| | |
|---|---|
| Scourol E-13 (soaping agent of Kao Sekken Co., Ltd.) | 2 g/l |
| Sodium hydroxide | 1 g/l |
| Sodium hydrosulfite | 2 g/l |
| Bath ratio | 1/30 |
| Temperature | 80° C. |
| Time | 10 min |

Evaluation:

The level-dyeing was judged on the basis of a partial irregularity of the deep shade by macroscopic observation. Further, dyeing fastnesses to rubbing and also to alkaline sweat of the cloth after the reduction clearing were determined and employed as criteria for the reduction clearing property. The dyeing fastnesses were determined according to JIS. Further, 300 g of a mixture of 30° DH water, dyes (mixture of the above dyes, i.e. 0.1% of Orange, 0.05% of Blue and 0.05% of Red), 0.02% of Levenol V-500 and 0.2% of additives was prepared and filtered through a 5A Filter Paper (a product of Toyo Roshi Co., Ltd.) after leaving to stand for 24 h. The state of the filtration residue was examined by visual observation and employed as a criterion of the dye dispersibility.

TABLE 2

| | | | (1) | (2) | (3) | (4) | (5) | (6) | (7) | (8) |
|---|---|---|---|---|---|---|---|---|---|---|
| Additive | ethylenediaminetetraacetic acid (g/l) | | 0 | 3 | 0 | 0 | 0 | 0 | 0 | 0 |
| | sodium tripolyphosphate (g/l) | | 0 | 0 | 3 | 0 | 0 | 0 | 0 | 0 |
| | Preparation Ex. 1 (g/l) | | 0 | 0 | 0 | 3 | 0 | 0 | 0 | 0 |
| | Preparation Ex. 2 (g/l) | | 0 | 0 | 0 | 0 | 3 | 0 | 0 | 0 |
| | Preparation Ex. 3 (g/l) | | 0 | 0 | 0 | 0 | 0 | 3 | 0 | 0 |
| | Preparation Ex. 4 (g/l) | | 0 | 0 | 0 | 0 | 0 | 0 | 3 | 0 |
| | Preparation Ex. 5 (g/l) | | 0 | 0 | 0 | 0 | 0 | 0 | 0 | 3 |
| Leveling property | | | x | Δ | Δ | ○ | ○ | ○ | ○ | ○ |
| Reduction clearing property | color fastness to rubbing | dry (grade) | 3–4 | 3–4 | 3–4 | 4 | 4 | 4 | 4 | 4 |
| | | wet (grade) | 3 | 3 | 3 | 3–4 | 3–4 | 3–4 | 3–4 | 3–4 |
| | color fastness to alkaline sweat (grade) | | 3 | 3 | 3 | 3–4 | 3–4 | 3–4 | 3–4 | 3–4 |
| Dye dispersibility | | | x | Δ | Δ | ○ | ○ | ○ | ○ | ○ |

(Note)
○: good
Δ: slightly inferior
x: inferior

TABLE 3

| | | | (9) | (10) | (11) | (12) | (13) | (14) | (15) | (16) | (17) | (18) |
|---|---|---|---|---|---|---|---|---|---|---|---|---|
| Additive | ethylenediaminetetraacetic acid (g/l) | | 0 | 3 | 0 | 0 | 0 | 0 | 0 | 0 | 0 | 0 |
| | sodium tripolyphosphate (g/l) | | 0 | 0 | 3 | 0 | 0 | 0 | 0 | 0 | 0 | 0 |
| | Preparation Ex. 6 (g/l) | | 0 | 0 | 0 | 3 | 0 | 0 | 0 | 0 | 0 | 0 |
| | Preparation Ex. 7 (g/l) | | 0 | 0 | 0 | 0 | 3 | 0 | 0 | 0 | 0 | 0 |
| | Preparation Ex. 8 (g/l) | | 0 | 0 | 0 | 0 | 0 | 3 | 0 | 0 | 0 | 0 |
| | Preparation Ex. 9 (g/l) | | 0 | 0 | 0 | 0 | 0 | 0 | 3 | 0 | 0 | 0 |
| | Preparation Ex. 10 (g/l) | | 0 | 0 | 0 | 0 | 0 | 0 | 0 | 3 | 0 | 0 |
| | Preparation Ex. 11 (g/l) | | 0 | 0 | 0 | 0 | 0 | 0 | 0 | 0 | 3 | 0 |
| | Preparation Ex. 12 (g/l) | | 0 | 0 | 0 | 0 | 0 | 0 | 0 | 0 | 0 | 3 |
| Leveling property | | | x | Δ | Δ | ◎ | ◎ | ◎ | ◎ | ◎ | ◎ | ◎ |
| Reduction clearing property | color fastness to rubbing | dry (grade) | 3–4 | 3–4 | 3–4 | 4+ | 4+ | 4+ | 4+ | 4+ | 4+ | 4+ |
| | | wet (grade) | 3 | 3 | 3 | 3–4+ | 3–4+ | 3–4+ | 3–4+ | 3–4+ | 3–4+ | 3–4+ |
| | color fastness to alkaline sweat (grade) | | 3 | 3 | 3 | 3–4+ | 3–4 | 3–4+ | 3–4+ | 3–4+ | 3–4+ | 3–4+ |
| Dye dispersibility | | | x | Δ | Δ | ◎ | ◎ | ◎ | ◎ | ◎ | ◎ | ◎ |

(Note)
◎: very good
○: good
Δ: slightly inferior
x: inferior
3–4+: a grade intermediate between 3–4 and 4
4+: a grade intermediate between 4 and 4–5

TABLE 4

| | | (19) | (20) | (21) | (22) | (23) | (24) | (25) | (26) | (27) | (28) | (29) |
|---|---|---|---|---|---|---|---|---|---|---|---|---|
| Additive | ethylenediaminetetraacetic acid (g/l) | 0 | 3 | 0 | 0 | 0 | 0 | 0 | 0 | 0 | 0 | 0 |
| | sodium tripolyphosphate (g/l) | 0 | 0 | 3 | 0 | 0 | 0 | 0 | 0 | 0 | 0 | 0 |
| | Preparation Ex. 13 (g/l) | 0 | 0 | 0 | 3 | 0 | 0 | 0 | 0 | 0 | 0 | 0 |
| | Preparation Ex. 14 (g/l) | 0 | 0 | 0 | 0 | 3 | 0 | 0 | 0 | 0 | 0 | 0 |
| | Preparation Ex. 15 (g/l) | 0 | 0 | 0 | 0 | 0 | 3 | 0 | 0 | 0 | 0 | 0 |
| | Preparation Ex. 16 (g/l) | 0 | 0 | 0 | 0 | 0 | 0 | 3 | 0 | 0 | 0 | 0 |
| | Preparation Ex. 17 (g/l) | 0 | 0 | 0 | 0 | 0 | 0 | 0 | 3 | 0 | 0 | 0 |
| | Preparation Ex. 18 (g/l) | 0 | 0 | 0 | 0 | 0 | 0 | 0 | 0 | 3 | 0 | 0 |
| | Preparation Ex. 19 (g/l) | 0 | 0 | 0 | 0 | 0 | 0 | 0 | 0 | 0 | 3 | 0 |
| | Preparation Ex. 20 (g/l) | 0 | 0 | 0 | 0 | 0 | 0 | 0 | 0 | 0 | 0 | 3 |
| Leveling property | | x | Δ | Δ | ○~◎ | ○~◎ | ○~◎ | ○~◎ | ○~◎ | ○~◎ | ○~◎ | ○~◎ |
| Reduction clearing property | color fastness to rubbing dry (grade) | 3–4 | 3–4 | 3–4 | 4+ | 4+ | 4+ | 4+ | 4+ | 4+ | 4+ | 4+ |
| | color fastness to rubbing wet (grade) | 3 | 3 | 3 | 3–4+ | 3–4+ | 3–4+ | 3–4+ | 3–4+ | 3–4+ | 3–4+ | 3–4+ |
| | color fastness to alkaline sweat (grade) | 3 | 3 | 3 | 3–4+ | 3–4 | 3–4+ | 3–4+ | 3–4+ | 3–4+ | 3–4+ | 3–4 + |
| Dye dispersibility | | x | Δ | Δ | ○~◎ | ○~◎ | ○~◎ | ○~◎ | ○~◎ | ○~◎ | ○~◎ | ○~◎ |

(Note)
◎: very good
○: good
Δ: slightly inferior
x: inferior
3–4+: a grade intermediate between 3–4 and 4
4+: a grade intermediate between 4 and 4–5

EXAMPLE 2

A nylon tropical was dyed and the dyeability and dye dispersibility were examined The results are shown in Tables 5 to 7.

Dyeing conditions:

| | |
|---|---|
| Hardness of water used | 40° DH |
| Dye | Kayanol Milling Red RSN 50 g/l (an acid dye of Nippon Kayaku Co., Ltd.) |
| Levenol WA (a levelling agent of Kao Sekken Co., Ltd.) | 1 g/l |
| Softex A-211 (a softening agent of Kao Sekken Co., Ltd.) | 10 g/l |
| Additive | see Tables 5 to 7 |
| pH | 4.0 (with ammonium acetate) |
| Bath ratio | 1/20 |
| Temperature | 100° C. |
| Time | 40 min |

Remarks:

A polypropylene tropical was thrown in the bath in the dyeing step. After completion of the dyeing, the textile was washed and treated with acetic acid in an ordinary manner.

Evaluation:

Leveling property was judged on the basis of a partial irregularity of the deep shade by macroscopic observation. A polypropylene-staining state was judged by a macroscopic observation to obtain a criterion of polypropylene-staining resistance. Further, color fastnesses of the dyed cloth to rubbing and also to alkaline sweat were also determined and employed as criteria for the washability. The color fastnesses were determined according to JIS. 300 cc of the dyeing solution was left to stand for 24 h and filtered through a 5A Filter Paper (a product of Toyo Roshi Co., Ltd.). The state of the filtration residue was examined by visual observation and employed as a criterion of the dye dispersibility.

TABLE 5

| | | (30) | (31) | (32) | (33) | (34) | (35) | (36) | (37) |
|---|---|---|---|---|---|---|---|---|---|
| Additive | ethylenediaminetetraacetic acid (g/l) | 0 | 2 | 0 | 0 | 0 | 0 | 0 | 0 |
| | sodium tripolyphosphate (g/l) | 0 | 0 | 2 | 0 | 0 | 0 | 0 | 0 |
| | Preparation Ex. 1 (g/l) | 0 | 0 | 0 | 2 | 0 | 0 | 0 | 0 |
| | Preparation Ex. 2 (g/l) | 0 | 0 | 0 | 0 | 2 | 0 | 0 | 0 |
| | Preparation Ex. 3 (g/l) | 0 | 0 | 0 | 0 | 0 | 2 | 0 | 0 |
| | Preparation Ex. 4 (g/l) | 0 | 0 | 0 | 0 | 0 | 0 | 2 | 0 |
| | Preparation Ex. 5 (g/l) | 0 | 0 | 0 | 0 | 0 | 0 | 0 | 2 |
| Leveling property | | x | Δ | Δ | ○ | ○ | ○ | ○ | ○ |
| Polypropylene staining resistance | | x | x | x | | | | | |
| Wash-ability | color fastness to rubbing dry (grade) | 3–4 | 3–4 | 3–4 | 4 | 4 | 4 | 4 | 4 |
| | color fastness to rubbing wet (grade) | 3 | 3 | 3 | 3–4 | 3–4 | 3–4 | 3–4 | 3–4 |
| | color resistance to alkaline sweat (grade) | 3 | 3 | 3 | 3–4 | 3–4 | 3–4 | 3–4 | 3–4 |
| Dye dispersibility | | x | Δ | Δ | ○ | ○ | ○ | ○ | ○ |

(Note)
○: good
Δ: slightly inferior
x: inferior

TABLE 6

| | | (38) | (39) | (40) | (41) | (42) | (43) | (44) | (45) | (46) | (47) |
|---|---|---|---|---|---|---|---|---|---|---|---|
| Additive | ethylenediaminetetraacetic acid (g/l) | 0 | 2 | 0 | 0 | 0 | 0 | 0 | 0 | 0 | 0 |
| | sodium tripolyphosphate (g/l) | 0 | 0 | 2 | 0 | 0 | 0 | 0 | 0 | 0 | 0 |
| | Preparation Ex. 6 (g/l) | 0 | 0 | 0 | 2 | 0 | 0 | 0 | 0 | 0 | 0 |
| | Preparation Ex. 7 (g/l) | 0 | 0 | 0 | 0 | 2 | 0 | 0 | 0 | 0 | 0 |
| | Preparation Ex. 8 (g/l) | 0 | 0 | 0 | 0 | 0 | 2 | 0 | 0 | 0 | 0 |
| | Preparation Ex. 9 (g/l) | 0 | 0 | 0 | 0 | 0 | 0 | 2 | 0 | 0 | 0 |
| | Preparation Ex. 10 (g/l) | 0 | 0 | 0 | 0 | 0 | 0 | 0 | 2 | 0 | 0 |
| | Preparation Ex. 11 (g/l) | 0 | 0 | 0 | 0 | 0 | 0 | 0 | 0 | 2 | 0 |
| | Preparation Ex. 12 (g/l) | 0 | 0 | 0 | 0 | 0 | 0 | 0 | 0 | 0 | 2 |
| Leveling property | | x | Δ | Δ | ◎ | ◎ | ◎ | ◎ | ◎ | ◎ | ◎ |
| Polypropylene staining resistance | | x | x | x | ◎ | ◎ | ◎ | ◎ | ◎ | ◎ | ◎ |
| Reduction clearing property | color fastness to rubbing dry (grade) | 3–4 | 3–4 | 3–4 | 4+ | 4+ | 4+ | 4+ | 4+ | 4+ | 4+ |
| | color fastness to rubbing wet (grade) | 3 | 3 | 3 | 3–4+ | 3–4+ | 3–4+ | 3–4+ | 3–4+ | 3–4+ | 3–4+ |
| | color fastness to alkaline sweat (grade) | 3 | 3 | 3 | 3–4+ | 3–4 | 3–4+ | 3–4+ | 3–4+ | 3–4+ | 3–4+ |
| Dye dispersibility | | x | Δ | Δ | ◎ | ◎ | ◎ | ◎ | ◎ | ◎ | ◎ |

(Note)
: very good
: good
Δ: slightly inferior
x: inferior
3–4+: a grade intermediate between 3–4 and 4
4+: a grade intermediate between 4 and 4–5

TABLE 7

| | | (48) | (49) | (50) | (51) | (52) | (53) | (54) | (55) | (56) | (57) | (58) |
|---|---|---|---|---|---|---|---|---|---|---|---|---|
| Additive | ethylenediaminetetraacetic acid (g/l) | 0 | 2 | 0 | 0 | 0 | 0 | 0 | 0 | 0 | 0 | 0 |
| | sodium tripolyphosphate (g/l) | 0 | 0 | 2 | 0 | 0 | 0 | 0 | 0 | 0 | 0 | 0 |
| | Preparation Ex. 13 (g/l) | 0 | 0 | 0 | 2 | 0 | 0 | 0 | 0 | 0 | 0 | 0 |
| | Preparation Ex. 14 (g/l) | 0 | 0 | 0 | 0 | 2 | 0 | 0 | 0 | 0 | 0 | 0 |
| | Preparation Ex. 15 (g/l) | 0 | 0 | 0 | 0 | 0 | 2 | 0 | 0 | 0 | 0 | 0 |
| | Preparation Ex. 16 (g/l) | 0 | 0 | 0 | 0 | 0 | 0 | 2 | 0 | 0 | 0 | 0 |
| | Preparation Ex. 17 (g/l) | 0 | 0 | 0 | 0 | 0 | 0 | 0 | 2 | 0 | 0 | 0 |
| | Preparation Ex. 18 (g/l) | 0 | 0 | 0 | 0 | 0 | 0 | 0 | 0 | 2 | 0 | 0 |
| | Preparation Ex. 19 (g/l) | 0 | 0 | 0 | 0 | 0 | 0 | 0 | 0 | 0 | 2 | 0 |
| | Preparation Ex. 20 (g/l) | 0 | 0 | 0 | 0 | 0 | 0 | 0 | 0 | 0 | 0 | 2 |
| Leveling property | | x | Δ | Δ | ○~◎ | ○~◎ | ○~◎ | ○~◎ | ○~◎ | ○~◎ | ○~◎ | ○~◎ |
| Reduction clearing property | color fastness to rubbing dry (grade) | 3–4 | 3–4 | 3–4 | 4+ | 4+ | 14+ | 4+ | 4+ | 4+ | 4+ | 4+ |
| | color fastness to rubbing wet (grade) | 3 | 3 | 3 | 3–4+ | 3–4+ | 3–4+ | 3–4+ | 3–4+ | 3–4+ | 3–4+ | 3–4+ |
| | color fastness to alkaline hu + sweat (grade) | 3 | 3 | 3 | 3–4+ | 3–4 | 3–4+ | 3–4+ | 3–4+ | 3–4+ | 3–4+ | 3–4 |
| Dye dispersibility | | x | Δ | Δ | ○~◎ | ○~◎ | ○~◎ | ○~◎ | ○~◎ | ○~◎ | ○~◎ | ○~◎ |

(Note)
◎: very good
○: good
Δ: slightly inferior
x: inferior
3–4+: a grade intermediate between 3–4 and 4
4+: a grade intermediate between 4 and 4–5

EXAMPLE 3

A cotton twill woven fabric was dyed and a hue and leveling property (level-dyeing property) thereof and the dye dispersibility in the dyeing solution were examined. The results are shown in Table 8.

Dyeing conditions:

| | |
|---|---|
| Hardness of water used | 0 and 20° DH |
| Dye | Kayarus Spra Blue 4 BL Conc. 1% owf (a metal-containing direct dye of Nippon Kayaku Co., Ltd.) |
| Glauber's salt | 10% owf |
| Additives | see Table 8 |
| Bath ratio | 1/30 |
| Dyeing temperature | 90° C. |
| Dyeing Time | 30 min |

Remarks:

The soaping was effected by an ordinary method after the dyeing.

Evaluation:

The dyed cloth was subjected to a colorimetry using an SM Color Computer SM-3 (a product of Suga Shikenki Co., Ltd.) to determine the hue (value according to the Munsell color system). The level dyeing was judged on the basis of a partial irregularity of the deep shade determined by macroscopic observation. Further, 300 g of a mixture (dyeing solution) of water, 0.1% of a dyestuff and 0.1% of an additive was prepared, then left to stand for 24 h and filtered through a 5A Filter Paper (a product of Toyo Roshi Co., Ltd.). The state of the filtration residue was examined by visual observation and employed as a criterion of the dye dispersibility.

TABLE 8

| Additive | | Hardness of water 0° DH Test No. (59) | (60) | (61) | (62) | (63) | (64) | (65) | (66) |
|---|---|---|---|---|---|---|---|---|---|
| Ethylenediaminetetraacetic acid (g/l) | | 0 | 1 | 0 | 0 | 0 | 0 | 0 | 0 |
| Processability-improving agent | Preparation Ex. 1 (g/l) | 0 | 0 | 1 | 0 | 0 | 0 | 0 | 0 |
| | Preparation Ex. 2 (g/l) | 0 | 0 | 0 | 1 | 0 | 0 | 0 | 0 |
| | Preparation Ex. 3 (g/l) | 0 | 0 | 0 | 0 | 1 | 0 | 0 | 0 |
| | Preparation Ex. 4 (g/l) | 0 | 0 | 0 | 0 | 0 | 1 | 0 | 0 |
| | Preparation Ex. 5 (g/l) | 0 | 0 | 0 | 0 | 0 | 0 | 1 | 0 |
| Comparative Preparation Ex. 1 (g/l) | | 0 | 0 | 0 | 0 | 0 | 0 | 0 | 1 |
| Hue | | 2.51 PB | 7.58 PB | 2.53 PB | 2.48 PB | 2.50 PB | 2.51 PB | 2.49 PB | 3.75 PB |
| Partial irregularity of deep shade | | none | none | none | none | none | none | none | none |
| Filtration residue | | none | none | none | none | none | none | none | none |

| Additive | | Hardness of water 20° DH Test No. (67) | (68) | (69) | (70) | (71) | (72) | (73) | (74) |
|---|---|---|---|---|---|---|---|---|---|
| Ethylenediaminetetraacetic acid (g/l) | | 0 | 1 | 0 | 0 | 0 | 0 | 0 | 0 |
| Processability-improving agent | Preparation Ex. 1 (g/l) | 0 | 0 | 1 | 0 | 0 | 0 | 0 | 0 |
| | Preparation Ex. 2 (g/l) | 0 | 0 | 0 | 1 | 0 | 0 | 0 | 0 |
| | Preparation Ex. 3 (g/l) | 0 | 0 | 0 | 0 | 1 | 0 | 0 | 0 |
| | Preparation Ex. 4 (g/l) | 0 | 0 | 0 | 0 | 0 | 1 | 0 | 0 |
| | Preparation Ex. 5 (g/l) | 0 | 0 | 0 | 0 | 0 | 0 | 1 | 0 |
| Comparative Preparation Ex. 1 (g/l) | | 0 | 0 | 0 | 0 | 0 | 0 | 0 | 1 |
| Hue | | 2.58 PB | 3.85 PB | 2.54 PB | 2.56 PB | 2.53 PB | 2.52 PB | 2.55 PB | 3.13 PB |
| Partial irregularity of deep shade | | observed | slight | none | none | none | none | none | slight |
| Filtration residue | | observed | slight | none | none | none | none | none | slight |

(Note)
PB in the column of "Hue" represents a bluish purple hue. The lower the value PB, the higher the bluishness. The higher the value PB, the higher the purplishness.

EXAMPLE 4

A cotton knitting was dyed and a hue and level-dyeing property thereof and the dye dispersibility in the dyeing solution were examined. The results shown in Table 9.

Dyeing conditions:

| | |
|---|---|
| Hardness of water used | 0 and 20° DH |
| Dye | Sumifix Red 3B 1% owf (a metal-containing reactive dye of Sumitomo Kagaku Kogyo Co., Ltd.) |
| Glauber's salt | 30 g/l |
| Soda ash | 15 g/l |
| Additive | see Table 9 |
| Bath ratio | 1/30 |
| Dyeing temperature | 60° C. |
| Dyeing time | 30 min |

Remark:

The soaping was effected by an ordinary method after the dyeing.

Evaluation:

The dyed cloth was subjected to a colorimetry using an SM Color Computer SM-3 (a product of Suga Shikenki Co., Ltd.) to determine the hue (value according to the Munsell color system). The level-dyeing was judged on the basis of a partial irregularity of the deep shade determined by macroscopic observation. Further, 300 g of a mixture (dyeing solution) of water, 0.1% of a dye and 0.2% of additive was prepared, then left to stand for 24 h and filtered through a 5A Filter Paper (a product of Toyo Roshi Co., Ltd.). The state of the filtration residue was examined by visual observation and employed as a criterion of the dye dispersibility.

TABLE 9

| Test No. | Hardness of water | Additive (g/d) Diethylenetriaminepentaacetic acid | Processability-improving agent Preparation Ex. 6 | Preparation Ex. 7 | Preparation Ex. 8 | Preparation Ex. 9 | Preparation Ex. 10 | Preparation Ex. 11 | Preparation Ex. 12 | Hue | Partial irregularity of deep shade | Filtration residue |
|---|---|---|---|---|---|---|---|---|---|---|---|---|
| 75 | 0°DH | 0 | 0 | 0 | 0 | 0 | 0 | 0 | 0 | 5.41 RP | none | none |
| 76 | | 2 | 0 | 0 | 0 | 0 | 0 | 0 | 0 | 2.01 RP | " | " |
| 77 | | 0 | 2 | 0 | 0 | 0 | 0 | 0 | 0 | 5.41 RP | " | " |
| 78 | | 0 | 0 | 2 | 0 | 0 | 0 | 0 | 0 | 5.41 RP | " | " |
| 79 | | 0 | 0 | 0 | 2 | 0 | 0 | 0 | 0 | 5.42 RP | " | " |
| 80 | | 0 | 0 | 0 | 0 | 2 | 0 | 0 | 0 | 5.40 RP | " | " |
| 81 | | 0 | 0 | 0 | 0 | 0 | 2 | 0 | 0 | 5.39 RP | " | " |
| 82 | | 0 | 0 | 0 | 0 | 0 | 0 | 2 | 0 | 5.41 RP | " | " |
| 83 | | 0 | 0 | 0 | 0 | 0 | 0 | 0 | 2 | 5.40 RP | " | " |
| 84 | 20°DH | 0 | 0 | 0 | 0 | 0 | 0 | 0 | 0 | 5.37 RP | observed | observed |
| 85 | | 2 | 0 | 0 | 0 | 0 | 0 | 0 | 0 | 4.75 RP | slight | slight |
| 86 | | 0 | 2 | 0 | 0 | 0 | 0 | 0 | 0 | 5.39 RP | none | none |
| 87 | | 0 | 0 | 2 | 0 | 0 | 0 | 0 | 0 | 5.40 RP | " | " |
| 88 | | 0 | 0 | 0 | 2 | 0 | 0 | 0 | 0 | 5.40 RP | " | " |
| 89 | | 0 | 0 | 0 | 0 | 2 | 0 | 0 | 0 | 5.38 RP | " | " |
| 90 | | 0 | 0 | 0 | 0 | 0 | 2 | 0 | 0 | 5.41 RP | " | " |

TABLE 9-continued

| Test No. | Hardness of water | Additive (g/d) Diethylenetriaminepentaacetic acid | Processability-improving agent Preparation Ex. 6 | Preparation Ex. 7 | Preparation Ex. 8 | Preparation Ex. 9 | Preparation Ex. 10 | Preparation Ex. 11 | Preparation Ex. 12 | Hue | Partial irregularity of deep shade | Filtration residue |
|---|---|---|---|---|---|---|---|---|---|---|---|---|
| 91 | | 0 | 0 | 0 | 0 | 0 | 0 | 2 | 0 | 5.40 RP | " | " |
| 92 | | 0 | 0 | 0 | 0 | 0 | 0 | 0 | 2 | 5.41 RP | " | " |

(Note) RP in the column of "Hue" represents a reddish purple hue. The lower the value RP, the higher the purplishness. The higher the value RP, the higher the reddishness.

It is apparent from the results shown in Table 8 and 9 that when water having a high hardness is used, problems of level dyeing property and dye dispersibility are posed unless the additive is used, though hue deviation or color change (deviation from an intended hue of a dyestuff used) is not observed unlike the case of using water of a low hardness. When diethylenetriaminepentaacetic acid is used as the additive, both deviation of the hue and color change are observed and the level dyeing property and dye dispersibility are slightly inferior. On the other hand, when the processability-improving agent of the present invention is used, neither the hue value deviation nor the color change is observed and excellent level-dyeing property and dye dispersibility can be obtained. When water of a low hardness and diethylenetriaminepentaacetic acid as the additive are used, a serious color change is caused due to the hue value deviation and the hue of the resulting dyeing is utterly different from an intended hue.

EXAMPLE 5

A cotton twill woven fabric was dyed and its depth was examined. The results are shown in Table 10.

Dyeing conditions:

| | |
|---|---|
| Hardness of water used | 0, 25 and 50° DH |
| Dye | Mikethren Blue RSN s/f 1% owf (a threne dye of Mitsui Toatsu Kagaku Co., Ltd.) |
| Sodium hydrosulfite | 4 g/l |
| Sodium hydroxide | 5 g/l |
| Additve | see Table 10 |
| Dyeing temperature | 60° C. |
| Dyeing time | 20 min |

Remark:

The oxidation and subsequent soaping were effected by an ordinary method after the dyeing.

Evaluation:

The dyed cloth was subjected to a colorimetry using an SM Color Computer SM-3 (a product of Suga Shikenki Co., Ltd.) to determine C* value used as a measure of the color depth.

TABLE 10

| Additive | | Hardness of water 0°DH Test No. (93) | (94) | (95) | (96) | (97) | (98) | (99) | (100) | (101) | (102) | 25°DH (103) | (104) | (105) | (106) | (107) |
|---|---|---|---|---|---|---|---|---|---|---|---|---|---|---|---|---|
| Ethylenediaminetetraacetic acid (g/l) | | 0 | 2 | 0 | 0 | 0 | 0 | 0 | 0 | 0 | 0 | 0 | 2 | 0 | 0 | 0 |
| Processability-improving agent | Preparation Ex. 13 (g/d) | 0 | 0 | 2 | 0 | 0 | 0 | 0 | 0 | 0 | 0 | 0 | 0 | 2 | 0 | 0 |
| | Preparation Ex. 14 (g/d) | 0 | 0 | 0 | 2 | 0 | 0 | 0 | 0 | 0 | 0 | 0 | 0 | 0 | 2 | 0 |
| | Preparation Ex. 15 (g/d) | 0 | 0 | 0 | 0 | 2 | 0 | 0 | 0 | 0 | 0 | 0 | 0 | 0 | 0 | 2 |
| | Preparation Ex. 16 (g/d) | 0 | 0 | 0 | 0 | 0 | 2 | 0 | 0 | 0 | 0 | 0 | 0 | 0 | 0 | 0 |
| | Preparation Ex. 17 (g/d) | 0 | 0 | 0 | 0 | 0 | 0 | 2 | 0 | 0 | 0 | 0 | 0 | 0 | 0 | 0 |
| | Preparation Ex. 18 (g/d) | 0 | 0 | 0 | 0 | 0 | 0 | 0 | 2 | 0 | 0 | 0 | 0 | 0 | 0 | 0 |
| | Preparation Ex. 19 (g/d) | 0 | 0 | 0 | 0 | 0 | 0 | 0 | 0 | 2 | 0 | 0 | 0 | 0 | 0 | 0 |
| | Preparation Ex. 20 (g/d) | 0 | 0 | 0 | 0 | 0 | 0 | 0 | 0 | 0 | 2 | 0 | 0 | 0 | 0 | 0 |
| C* | | 10.53 | 10.52 | 10.55 | 10.54 | 10.55 | 10.53 | 10.54 | 10.52 | 10.55 | 10.55 | 9.68 | 9.97 | 11.35 | 11.39 | 11.61 |

| Additive | | 25°DH Test No. (108) | (109) | (110) | (111) | (112) | 50°DH (113) | (114) | (115) | (116) | (117) | (118) | (119) | (120) | (121) | (122) |
|---|---|---|---|---|---|---|---|---|---|---|---|---|---|---|---|---|
| Ethylenediaminetetraacetic acid (g/l) | | 0 | 0 | 0 | 0 | 0 | 0 | 2 | 0 | 0 | 0 | 0 | 0 | 0 | 0 | 0 |
| Processability-improving agent | Preparation Ex. 13 (g/d) | 0 | 0 | 0 | 0 | 0 | 0 | 0 | 2 | 0 | 0 | 0 | 0 | 0 | 0 | 0 |
| | Preparation Ex. 14 (g/d) | 0 | 0 | 0 | 0 | 0 | 0 | 0 | 0 | 2 | 0 | 0 | 0 | 0 | 0 | 0 |
| | Preparation Ex. 15 (g/d) | 0 | 0 | 0 | 0 | 0 | 0 | 0 | 0 | 0 | 2 | 0 | 0 | 0 | 0 | 0 |
| | Preparation Ex. 16 (g/d) | 2 | 0 | 0 | 0 | 0 | 0 | 0 | 0 | 0 | 0 | 2 | 0 | 0 | 0 | 0 |

TABLE 10-continued

| | | | | | | | | | | | | | | | |
|---|---|---|---|---|---|---|---|---|---|---|---|---|---|---|---|
| Preparation Ex. 17 (g/d) | 0 | 2 | 0 | 0 | 0 | 0 | 0 | 0 | 0 | 0 | 0 | 2 | 0 | 0 | 0 |
| Preparation Ex. 18 (g/d) | 0 | 0 | 2 | 0 | 0 | 0 | 0 | 0 | 0 | 0 | 0 | 0 | 2 | 0 | 0 |
| Preparation Ex. 19 (g/d) | 0 | 0 | 0 | 2 | 0 | 0 | 0 | 0 | 0 | 0 | 0 | 0 | 0 | 2 | 0 |
| Preparation Ex. 20 (g/d) | 0 | 0 | 0 | 0 | 2 | 0 | 0 | 0 | 0 | 0 | 0 | 0 | 0 | 0 | 2 |
| C* | 11.56 | 11.53 | 11.51 | 11.28 | 11.31 | 8.83 | 9.24 | 12.01 | 12.08 | 12.31 | 12.26 | 12.22 | 12.15 | 11.93 | 11.95 |

(Note)
C* is a value calculated according to the forming: $C^* = 21.72 \times 10^{C \cdot \tan H^*/2V/2}$ wherein C is a saturation according to Munsell color system and V is a lightness according to Munsell color system, $\tan H^*$ is $0.01 + 0.001\Delta H_{5P}$, $\Delta H_{5P}$ being the number of steps from a position of hue 5.0P in the Munsell hue circle. The lower the value, the paler the shade (the smaller the color depth). The higher the value, the deeper the shade (the larger the color depth).

It is apparent from the results shown in Table 10 that when no additive was used, the value C* was reduced as the hardness of water was increased and no sufficient color depth was obtained. When ethylenediaminetetraacetic acid was used as the additive, slightly improved effects were obtained but they were still poor. On the other hand, when the processability-improving agent of the present invention was used, the value C* was increased as the hardness of water was increased, thus exhibiting a hyperchromic effect. When the additive prepared in the comparative preparation example was used, a C* value substantially on the same level as that of water having a hardness of 0 was obtained even when the hardness of water was increased but it was yet insufficient for obtaining the hyperchromic effect.

EXAMPLE 6

A desized cotton gaberdine cloth was scoured to examine its scouring properties. The results are shown in Table 11.

Scouring conditions:

| | |
|---|---|
| Hardness of water used | 20° DH |
| Bath ratio | 1/25 |
| Temperature | 95° C. |
| Time | 90 min |
| Additive | see Table 11 |

Evaluation:

Samples having 2.5 cm width were cut out of a treated cloth and the water absorption height in 30 sec was determined by Byreck method. The results were employed as a measure of wettability.

TABLE 11

| | | (123) | (124) | (125) | (126) | (127) | (128) | (129) | (130) |
|---|---|---|---|---|---|---|---|---|---|
| Sodium hydroxide (flakes) (g/l) | | 10 | 10 | 10 | 10 | 10 | 10 | 10 | 10 |
| Scourol M-360 (g/l) (scouring agent of Kao Sekken Co., Ltd.) | | 2 | 2 | 2 | 2 | 2 | 2 | 2 | 2 |
| Ethylenediaminetetraacetic acid (g/l) | | 0 | 2 | 0 | 0 | 0 | 0 | 0 | 0 |
| Sodium tripolyphosphate (g/l) | | 0 | 0 | 2 | 0 | 0 | 0 | 0 | 0 |
| Processability-improving agent | Preparation Ex. 1 (g/l) | 0 | 0 | 0 | 2 | 0 | 0 | 0 | 0 |
| | Preparation Ex. 2 (g/l) | 0 | 0 | 0 | 0 | 2 | 0 | 0 | 0 |
| | Preparation Ex. 3 (g/l) | 0 | 0 | 0 | 0 | 0 | 2 | 0 | 0 |
| | Preparation Ex. 4 (g/l) | 0 | 0 | 0 | 0 | 0 | 0 | 2 | 0 |
| | Preparation Ex. 5 (g/l) | 0 | 0 | 0 | 0 | 0 | 0 | 0 | 2 |
| Wettability - Water absorption height (mm) - | | 34 | 41 | 39 | 56 | 66 | 60 | 65 | 63 |

EXAMPLE 7

A desized poplin of polyester/cotton (65/35) was scoured by the padding/steaming method to examine its scouring properties. The results are shown in Table 12.

Scouring conditions:

| | | |
|---|---|---|
| Padding | | |
| ↓ | Hardness of water used | 15° DH |
| ↓ | Bath ratio | 1/15 |
| ↓ | Temperature | Ambient temp. |
| ↓ | Time | 3 min |
| ↓ | Additive | see Table 12 |
| Squeeze | | |
| ↓ | Squeezing ratio | 80% |
| Steaming | | |
| ↓ | 105° C., 60 min | |
| Washing with hot water | | |
| ↓ | 60° C., 10 min | |
| Washing with water | | |
| | ambient temp., 5 min | |

Evaluation:

Samples having 2.5 cm width were cut out of a treated cloth and the water absorption height in 30 sec was determined by Byreck method. The results were employed as a measure of wettability.

TABLE 12

| Test No. | Sodium hydroxide (flakes) (g/l) | Scourol FC-300 (Scouring agent of Kao Sekken Co., Ltd.) (g/l) | Ethylenediamine-tetraacetic acid (g/l) | Sodium tripolyphosphate (g/l) | Scouring property-improving agent (g/l) Preparation Ex. 6 | 7 | 8 | 9 | 10 | 11 | 12 | Wettability water-absorption height (mm) |
|---|---|---|---|---|---|---|---|---|---|---|---|---|
| 131 | 7 | 2 | 0 | 0 | 0 | 0 | 0 | 0 | 0 | 0 | 0 | 23 |
| 132 | 7 | 2 | 1.5 | 0 | 0 | 0 | 0 | 0 | 0 | 0 | 0 | 26 |
| 133 | 7 | 2 | 0 | 1.5 | 0 | 0 | 0 | 0 | 0 | 0 | 0 | 25 |
| 134 | 7 | 2 | 0 | 0 | 1.5 | 0 | 0 | 0 | 0 | 0 | 0 | 61 |
| 135 | 7 | 2 | 0 | 0 | 0 | 1.5 | 0 | 0 | 0 | 0 | 0 | 66 |
| 136 | 7 | 2 | 0 | 0 | 0 | 0 | 1.5 | 0 | 0 | 0 | 0 | 65 |
| 137 | 7 | 2 | 0 | 0 | 0 | 0 | 0 | 1.5 | 0 | 0 | 0 | 63 |
| 138 | 7 | 2 | 0 | 0 | 0 | 0 | 0 | 0 | 1.5 | 0 | 0 | 65 |

TABLE 12-continued

| Test No. | Sodium hydroxide (flakes) (g/l) | Scourol FC-300 (Scouring agent of Kao Sekken Co., Ltd.) (g/l) | Ethylenediamine-tetraacetic acid (g/l) | Sodium tripolyphosphate (g/l) | Scouring property-improving agent (g/l) Preparation Ex. 6 | 7 | 8 | 9 | 10 | 11 | 12 | Wettability water-absorption height (mm) |
|---|---|---|---|---|---|---|---|---|---|---|---|---|
| 139 | 7 | 2 | 0 | 0 | 0 | 0 | 0 | 0 | 0 | 1.5 | 0 | 65 |
| 140 | 7 | 2 | 0 | 0 | 0 | 0 | 0 | 0 | 0 | 0 | 1.5 | 64 |

It is apparent from the results shown in Tables 11 and 12 that when only sodium hydroxide and the surfactant (Scourol FC-300) were used, the water absorption height was low and wettability and scouring property were poor and that when ethylenediaminetetraacetic acid or sodium tripolyphosphate was also used, the improvement in the scouring property was still insufficient. On the other hand, when the processability-improving agent of the present invention was used, a high water absorption height and excellent wettability and scouring properties were obtained.

EXAMPLE 8

A No. 40 plied cotton yarn was scoured with an Obermaier to examine its scouring properties. The results are shown in Table 13.

Scouring conditions:

| | |
|---|---|
| Hardness of water used | 20° DH |
| Bath ratio | 1/10 |
| Temperature | 100° C. |
| Time | 2 h |
| Additive | see Table 13 |

Evaluation:

A double knit was prepared from the thus treated fiber. Samples having 2.5 cm width were cut out of the knit and the water absorption height in 30 sec was determined by Byreck method. The results were employed as a measure of wettability.

It is apparent from the results shown in Table 13 that when only sodium hydroxide and the surfactant (Scorerol C-110) were used, the water absorption height was low and the wettability and scouring property were poor and that when diethylenetriaminepentaacetic acid or sodium tripolyphosphate was also used, the improvement in the scouring property was still insufficient. On the other hand, when the processability-improving agent of the present invention was used, a high water absorption height and excellent wettability and scouring properties were obtained.

EXAMPLE 9

A desized cotton satin cloth was scoured and bleached at the same time and its properties were examined. The results are shown in Table 14.

Scouring and bleaching conditions:

| | |
|---|---|
| Hardness of water used | 25° DH |
| Bath ratio | 1/25 |
| Temperature | 95° C. |
| Time | 60 min |
| Additive | see Table 14 |

Evaluation:

Samples having 2.5 cm width were cut out of the treated cloth and the water absorption height in 30 sec was determined by Byreck method. The results were employed as a measure of wettability.

TABLE 13

| | | (141) | (142) | (143) | (144) | (145) | (146) | (147) | (148) | (149) | (150) | (151) |
|---|---|---|---|---|---|---|---|---|---|---|---|---|
| Sodium hydroxide (flakes) (g/l) | | 15 | 15 | 15 | 15 | 15 | 15 | 15 | 15 | 15 | 15 | 15 |
| Scourol C-110 (g/l) (scouring agent of Kao Sekken Co., Ltd.) | | 3 | 3 | 3 | 3 | 3 | 3 | 3 | 3 | 3 | 3 | 3 |
| Diethylenetriaminepentaacetic acid (g/l) | | 0 | 3 | 0 | 0 | 0 | 0 | 0 | 0 | 0 | 0 | 0 |
| Sodium tripolyphosphate (g/l) | | 0 | 0 | 3 | 0 | 0 | 0 | 0 | 0 | 0 | 0 | 0 |
| Processability-improving agent | Preparation Ex. 13 (g/l) | 0 | 0 | 0 | 3 | 0 | 0 | 0 | 0 | 0 | 0 | 0 |
| | Preparation Ex. 14 (g/l) | 0 | 0 | 0 | 0 | 3 | 0 | 0 | 0 | 0 | 0 | 0 |
| | Preparation Ex. 15 (g/l) | 0 | 0 | 0 | 0 | 0 | 3 | 0 | 0 | 0 | 0 | 0 |
| | Preparation Ex. 16 (g/l) | 0 | 0 | 0 | 0 | 0 | 0 | 3 | 0 | 0 | 0 | 0 |
| | Preparation Ex. 17 (g/l) | 0 | 0 | 0 | 0 | 0 | 0 | 0 | 3 | 0 | 0 | 0 |
| | Preparation Ex. 18 (g/l) | 0 | 0 | 0 | 0 | 0 | 0 | 0 | 0 | 3 | 0 | 0 |
| | Preparation Ex. 19 (g/l) | 0 | 0 | 0 | 0 | 0 | 0 | 0 | 0 | 0 | 3 | 0 |
| | Preparation Ex. 20 (g/l) | 0 | 0 | 0 | 0 | 0 | 0 | 0 | 0 | 0 | 0 | 3 |
| Wettability - Water absorption height (mm) - | | 30 | 34 | 35 | 59 | 60 | 65 | 64 | 62 | 61 | 58 | 57 |

TABLE 14

| | | (152) | (153) | (154) | (155) | (156) | (157) | (158) | (159) | (160) | (161) | (162) |
|---|---|---|---|---|---|---|---|---|---|---|---|---|
| Sodium hydroxide (flakes) (g/l) | | 5 | 5 | 5 | 5 | 5 | 5 | 5 | 5 | 5 | 5 | 5 |
| Scourol FC-300 (g/l) (scouring agent of Kao Sekken Co., Ltd.) | | 2 | 2 | 2 | 2 | 2 | 2 | 2 | 2 | 2 | 2 | 2 |
| Hydrogen peroxide (35% aqueous solution) (g/l) | | 5 | 5 | 5 | 5 | 5 | 5 | 5 | 5 | 5 | 5 | 5 |
| Sodium metasilicate (g/l) | | 2 | 2 | 2 | 2 | 2 | 2 | 2 | 2 | 2 | 2 | 2 |
| Ethylenediaminetetraacetic acid (g/l) | | 0 | 2 | 0 | 0 | 0 | 0 | 0 | 0 | 0 | 0 | 0 |
| Sodium tripolyphosphate (g/l) | | 0 | 0 | 2 | 0 | 0 | 0 | 0 | 0 | 0 | 0 | 0 |
| Processability-improving agent | Preparation Ex. 13 (g/l) | 0 | 0 | 0 | 2 | 0 | 0 | 0 | 0 | 0 | 0 | 0 |
| | Preparation Ex. 14 (g/l) | 0 | 0 | 0 | 0 | 2 | 0 | 0 | 0 | 0 | 0 | 0 |
| | Preparation Ex. 15 (g/l) | 0 | 0 | 0 | 0 | 0 | 2 | 0 | 0 | 0 | 0 | 0 |
| | Preparation Ex. 16 (g/l) | 0 | 0 | 0 | 0 | 0 | 0 | 2 | 0 | 0 | 0 | 0 |
| | Preparation Ex. 17 (g/l) | 0 | 0 | 0 | 0 | 0 | 0 | 0 | 2 | 0 | 0 | 0 |

TABLE 14-continued

| | (152) | (153) | (154) | (155) | (156) | (157) | (158) | (159) | (160) | (161) | (162) |
|---|---|---|---|---|---|---|---|---|---|---|---|
| Preparation Ex. 18 (g/l) | 0 | 0 | 0 | 0 | 0 | 0 | 0 | 0 | 2 | 0 | 0 |
| Preparation Ex. 19 (g/l) | 0 | 0 | 0 | 0 | 0 | 0 | 0 | 0 | 0 | 2 | 0 |
| Preparation Ex. 20 (g/l) | 0 | 0 | 0 | 0 | 0 | 0 | 0 | 0 | 0 | 0 | 2 |
| Wettability - Water absorption height (mm) - | 28 | 34 | 34 | 60 | 61 | 70 | 65 | 64 | 62 | 58 | 59 |

It is apparent from the results shown in Table 14 that when only sodium hydroxide, surfactant (Scourol FC-300), hydrogen peroxide and sodium metasilicate were used, the water absorption height was low and the wettability and scouring property were poor and that even when ethylenediaminetetraacetic acid or sodium tripolyphosphate was also used, the improvement in the scouring property was yet insufficient. On the other hand, when the processability-improving agent of the present invention was used, a high water absorption height and excellent wettability and scouring properties were obtained.

EXAMPLE 10

A scoured cotton plain knitting was bleached to examine its bleaching properties. The results are shown in Table 15.

Bleaching conditions:

| | |
|---|---|
| Hardness of water used | 20° DH |
| Bath ratio | 1/25 |
| Temperature | 80° C. |
| Time | 30 min |
| Additive | see Table 15 |

Evaluation:

The hand of the treated knitting was judged by an organoleptic test. The degree of whiteness (W) was determined by subjecting the treated knitting to a colorimetry with an SM Color Computer SM-3 (a product of Suga Shikenki Co., Ltd.) and calculating the value of W according to the following Lab formula:

$$W=100-[(100-L)^{21}+a^2+b^2]^{\frac{1}{2}}$$

wherein L represents a determined lightness, a represents a determined chromaticness index and b represents a determined chromaticness index. Four sheets of cloths were put together to form a layer. The sewing properties were judged in terms of the number of breakages of the threads constituting the clothes after sewing the same in a length of 30 cm by means of a normal sewing machine using a #11S needle without using any sewing thread.

TABLE 15

| | | Test No. | | | | | | | | | |
|---|---|---|---|---|---|---|---|---|---|---|---|
| | | (163) | (164) | (165) | (166) | (167) | (168) | (169) | (170) | (171) | (172) |
| Hydrogen peroxide (g/l) | | 10 | 10 | 10 | 10 | 10 | 10 | 10 | 10 | 10 | 10 |
| Sodium hydroxide (flakes) (g/l) | | 2 | 2 | 2 | 2 | 2 | 2 | 2 | 2 | 2 | 2 |
| No. 3 sodium silicate (g/l) | | 5 | 5 | 5 | 5 | 5 | 5 | 5 | 5 | 5 | 5 |
| Ethylenediaminetetraacetic acid (g/l) | | 0 | 2 | 0 | 0 | 0 | 0 | 0 | 0 | 0 | 0 |
| Processability-improving agent | Preparation Ex. 13 (g/l) | 0 | 0 | 2 | 0 | 0 | 0 | 0 | 0 | 0 | 0 |
| | Preparation Ex. 14 (g/l) | 0 | 0 | 0 | 2 | 0 | 0 | 0 | 0 | 0 | 0 |
| | Preparation Ex. 15 (g/l) | 0 | 0 | 0 | 0 | 2 | 0 | 0 | 0 | 0 | 0 |
| | Preparation Ex. 16 (g/l) | 0 | 0 | 0 | 0 | 0 | 2 | 0 | 0 | 0 | 0 |
| | Preparation Ex. 17 (g/l) | 0 | 0 | 0 | 0 | 0 | 0 | 2 | 0 | 0 | 0 |
| | Preparation Ex. 18 (g/l) | 0 | 0 | 0 | 0 | 0 | 0 | 0 | 2 | 0 | 0 |
| | Preparation Ex. 19 (g/l) | 0 | 0 | 0 | 0 | 0 | 0 | 0 | 0 | 2 | 0 |
| | Preparation Ex. 20 (g/l) | 0 | 0 | 0 | 0 | 0 | 0 | 0 | 0 | 0 | 2 |
| Hand | | hard | slightly hard | soft | soft | soft | soft | soft | soft | soft | soft |
| Whiteness (W) | | 90.5 | 91.1 | 94.2 | 94.3 | 95.3 | 95.1 | 94.8 | 94.7 | 94.0 | 94.0 |
| Sewing property (number of breakages of threads constituting the cloth) | | 117 | 86 | 48 | 47 | 40 | 41 | 45 | 45 | 50 | 50 |

It is apparent from the results shown in Table 15 that when only hydrogen peroxide, sodium hydroxide and No. 3 sodium silicate were used, the resulting product had a low degree of whiteness and poor sewing properties and that even when ethylenediaminetetraacetic acid was used in addition to them, no remarkable improvement in the bleaching property could be obtained. On the other hand, when the processability-improving agent of the invention was used in combination with them, a soft hand and excellent whiteness, sewing properties and bleaching results could be obtained. When the additive obtained in the comparative preparation example was used, a soft hand and excellent whiteness and sewing properties could be obtained but they were still inferior to those obtained by using the processability-improving agent of the invention.

EXAMPLE 11

A raw silk was scoured and its properties were examined. The results are shown in Table 16.

Silk scouring conditions:

| | |
|---|---|
| Hardness of water used | 20° DH |
| Bath ratio | 1/30 |
| Temperature | boiling point |
| Time | 1 h |
| Additive | see Table 16 |

Evaluation:

The hand and gloss of the treated thread were examined by organoliptic tests. Further, the unevenness of scouring was also examined by a scanning electron microscope photography.

TABLE 16

| | | (173) | (174) | (175) | (176) | (177) | (178) | (179) | (180) |
|---|---|---|---|---|---|---|---|---|---|
| Additive | Marseille soap (g/l) (a product of Kao Sekken Co., Ltd.) | 5 | 5 | 5 | 5 | 5 | 5 | 5 | 5 |
| | Sodium silicate (g/l) | 2 | 2 | 2 | 2 | 2 | 2 | 2 | 2 |
| | Ethylenediaminetetraacetic acid (g/l) | 0 | 1.5 | 0 | 0 | 0 | 0 | 0 | 0 |
| | Sodium tripolyphosphate (g/l) | 0 | 0 | 1.5 | 0 | 0 | 0 | 0 | 0 |
| | Preparation Ex. 1 (g/l) | 0 | 0 | 0 | 1.5 | 0 | 0 | 0 | 0 |
| | Preparation Ex. 2 (g/l) | 0 | 0 | 0 | 0 | 1.5 | 0 | 0 | 0 |
| | Preparation Ex. 3 (g/l) | 0 | 0 | 0 | 0 | 0 | 1.5 | 0 | 0 |
| | Preparation Ex. 4 (g/l) | 0 | 0 | 0 | 0 | 0 | 0 | 1.5 | 0 |
| | Preparation Ex. 5 (g/l) | 0 | 0 | 0 | 0 | 0 | 0 | 0 | 1.5 |
| Hand | | hard | slightly hard | slightly hard | soft | soft | soft | soft | soft |
| Gloss | | inferior | slightly inferior | slightly inferior | good | good | good | good | good |
| Uneveness of scouring | | uneven | slight | slight | none | none | none | none | none |

It is apparent from the results shown in Table 16 that when only a Marseille soap and sodium silicate were used, the resulting product had poor hand, gloss and unevenness of scouring. Even when ethylenediaminetetraacetic acid or sodium tripolyphosphate was used in combination with them, only a slight improvement was attained. On the other hand, when the processability-improving agent of the present invention was used, excellent scouring effects were obtained, namely excellent hand and gloss and no unevenness of scouring were observed.

EXAMPLE 12

A textile of polyester spun fiber having an acrylic sizing agent was scoured and the scouring properties were examined. The results are shown in Table 17.

Scouring conditions:

| | |
|---|---|
| Hardness of water used | 20° DH |
| Bath ratio | 1/25 |
| Temperature | 95° C. |
| Time | 30 min |
| Additive | see Table 17 |

Evaluation:

The treated cloth was subjected to a shearing test using a KES-1 shearing tester (a product of Kato Tekkosho Co., Ltd.) to determine its shearing characteristic 2 HG 5. The lower the value of 2 HQ 5, the softer the hand. Further, the treated cloth was dyed under the following conditions and dyeing specks in the dyed cloth were examined to obtain a measure of the level dyeing.

Dyeing conditions:

| | |
|---|---|
| Disperse dyes | Dianix Orange B-SE 1% owf (a product of Mitsubishi Kasei Kogyo Co., Ltd.) Dianix Blue BG-FS 0.5% owf (a product of Mitsubishi Kasei Kogyo Co., Ltd.) Miketon Polyester Red 4BF 0.5% owf (a product of Mitsui Toatsu Kagaku Co., Ltd.) |
| Levenol TD-326 (a dye assistant of Kao Sekken Co., Ltd.) | 0.2 g/l |
| pH | 4.5 |
| Bath ratio | 1/20 |
| Temperature | 130° C. |
| Time | 30 min |

TABLE 17

| | | (181) | (182) | (183) | (184) | (185) | (186) | (187) | (188) | (189) | (190) |
|---|---|---|---|---|---|---|---|---|---|---|---|
| Additive | Scourol M-360 (g/l) (2 scouring agent of Kao Sekken Co., Ltd.) | 2 | 2 | 2 | 2 | 2 | 2 | 2 | 2 | 2 | 2 |
| | Sodium hydroxide (g/l) | 1 | 1 | 1 | 1 | 1 | 1 | 1 | 1 | 1 | 1 |
| | Ethylenediaminetetraacetic acid (g/l) | 0 | 2 | 0 | 0 | 0 | 0 | 0 | 0 | 0 | 0 |
| | Sodium tripolyphosphate (g/l) | 0 | 0 | 2 | 0 | 0 | 0 | 0 | 0 | 0 | 0 |
| | Preparation Ex. 6 (g/l) | 0 | 0 | 0 | 2 | 0 | 0 | 0 | 0 | 0 | 0 |
| | Preparation Ex. 7 (g/l) | 0 | 0 | 0 | 0 | 2 | 0 | 0 | 0 | 0 | 0 |
| | Preparation Ex. 8 (g/l) | 0 | 0 | 0 | 0 | 0 | 2 | 0 | 0 | 0 | 0 |
| | Preparation Ex. 9 (g/l) | 0 | 0 | 0 | 0 | 0 | 0 | 2 | 0 | 0 | 0 |
| | Preparation Ex. 10 (g/l) | 0 | 0 | 0 | 0 | 0 | 0 | 0 | 2 | 0 | 0 |
| | Preparation Ex. 11 (g/l) | 0 | 0 | 0 | 0 | 0 | 0 | 0 | 0 | 2 | 0 |
| | Preparation Ex. 12 (g/l) | 0 | 0 | 0 | 0 | 0 | 0 | 0 | 0 | 0 | 2 |
| 2 HG 5 (g/cm) | | 5.82 | 5.05 | 5.22 | 3.14 | 3.11 | 3.12 | 3.19 | 3.15 | 3.17 | 3.15 |
| Level dyeing property (freeness from dyeing specks) | | x | Δ | Δ | ◎ | ◎ | ◎ | ◎ | ◎ | ◎ | ◎ |

(Note)
◎: very good
○: good
Δ: slightly inferior
x: inferior

It is apparent from the results shown in Table 17 that when only the surfactant and sodium hydroxide were used, a high 2 HG 5 value and a hard hand were obtained, dyeing specks were observed and the scouring properties were poor. Even when ethylenediaminetetraacetic acid or sodium tripolyphosphate was also used, the results were improved only slightly. On the other hand, when the processability-improving agent of the invention was used, a low 2 HG 5 value and a soft hand were obtained, no dyeing specks were observed and the scouring properties were excellent.

EXAMPLE 13

The weight of a scoured polyester georgette was reduced with an alkali and its properties were examined. The results are shown in Table 18.

Alkali treatment conditions:

| | |
|---|---|
| Hardness of water used | 20° DH |
| Bath ratio | 1/30 |
| Temperature | 90° C. |
| Time | 30 min |
| Additive | see Table 18 |

Evaluation:

The 2 HG 5 employed as a measure of the hand was measured in the same manner as in Example 12 and the weight reduction with alkali was determined.

TABLE 18

| | | (191) | (192) | (193) | (194) | (195) | (196) | (197) | (198) | (199) | (200) | (201) |
|---|---|---|---|---|---|---|---|---|---|---|---|---|
| Additive | Sodium hydroxide (g/l) | 80 | 80 | 80 | 80 | 80 | 80 | 80 | 80 | 80 | 80 | 80 |
| | Ethylenediaminetetraacetic acid (g/l) | 0 | 2 | 0 | 0 | 0 | 0 | 0 | 0 | 0 | 0 | 0 |
| | Sodium tripolyphosphate (g/l) | 0 | 0 | 2 | 0 | 0 | 0 | 0 | 0 | 0 | 0 | 0 |
| | Preparation Ex. 13 (g/l) | 0 | 0 | 0 | 2 | 0 | 0 | 0 | 0 | 0 | 0 | 0 |
| | Preparation Ex. 14 (g/l) | 0 | 0 | 0 | 0 | 2 | 0 | 0 | 0 | 0 | 0 | 0 |
| | Preparation Ex. 15 (g/l) | 0 | 0 | 0 | 0 | 0 | 2 | 0 | 0 | 0 | 0 | 0 |
| | Preparation Ex. 16 (g/l) | 0 | 0 | 0 | 0 | 0 | 0 | 2 | 0 | 0 | 0 | 0 |
| | Preparation Ex. 17 (g/l) | 0 | 0 | 0 | 0 | 0 | 0 | 0 | 2 | 0 | 0 | 0 |
| | Preparation Ex. 18 (g/l) | 0 | 0 | 0 | 0 | 0 | 0 | 0 | 0 | 2 | 0 | 0 |
| | Preparation Ex. 19 (g/l) | 0 | 0 | 0 | 0 | 0 | 0 | 0 | 0 | 0 | 2 | 0 |
| | Preparation Ex. 20 (g/l) | 0 | 0 | 0 | 0 | 0 | 0 | 0 | 0 | 0 | 0 | 2 |
| 2 HG 5 (g/cm) | | 4.42 | 3.82 | 3.85 | 2.64 | 2.65 | 2.60 | 2.62 | 2.63 | 2.64 | 2.68 | 2.66 |

It is apparent from the results shown in Table 18 that when only sodium hydroxide was used, a high 2 HG 5 value and a poor hand were obtained and the weight reduction with alkali was inferior. Even when ethylenediaminetetraacetic acid or sodium tripolyphosphate was also used, the improvement was only slight, though the value of 2 HG 5 was lowered slightly. On the other hand, when the processability-improving agent of the invention was used, a low 2 HG 5 value and a soft hand were obtained and the weight reduction with alkali was excellent.

The embodiments of the invention in which an exclusive property or privilege is claimed are defined as follow:

1. In a method which comprises scouring cellulose fibers containing water-repellent substances, comprising greases, waxes or oils, to remove said water-repellent substances so that the penetration of chemicals is facilitated, and then subjecting the scoured fibers to bleaching, dyeing and finishing steps, the improvement which comprises: p1 in said scouring step, contacting said fibers, under scouring conditions, with an aqueous scouring solution containing an alkali, a surfactant effective for removing impurities from said fibers and, as a scouring property improving agent, for 0.01 to 20 grams, per liter of said scouring solution, of a water-soluble alkali metal, ammonium or alkanolamine salt of a polymer selected from the group consisting of polyacrylic acid, polymethacrylic acid, polymaleic acid, copolymer of maleic acid and acrylic acid, and copolymer of maleic acid and methacrylic acid, said salt having an average molecular weight of from 200 to 10,000.

2. A method as claimed in claim 1 in which, in the scouring step, said aqueous scouring solution is boiled.

3. A method as claimed in claim 1 in which said polymer is a copolymer of (1) maleic acid and (2) acrylic acid or methacrylic acid, wherein the monomer ratio (r) of (1) to (2) is from 1.15 to 2.7, the average molecular weight (MW) is from 1,000 to 8,000 and the value of (r)x(MW) is at least 3,000.

4. A method as claimed in claim 1 in which said polymer is a polymer of acrylic acid or methacrylic acid having a molecular weight of from 1,000 to 8,000.

5. A method as claimed in claim 1 in which said polymer is a polymer of maleic acid having a molecular weight of from 300 to 5,000.

6. A method according to claim 1 in which the amount of said scouring property-improving agent is from 0.04 to 10 g, per liter of said scouring solution.

7. A method according to claim 1 in which said alkali is sodium hydorxide.

* * * * *

UNITED STATES PATENT AND TRADEMARK OFFICE

CERTIFICATE OF CORRECTION

PATENT NO. : 4 595 394

DATED : June 17, 1986

INVENTOR(S) : Masakatsu OKAMOTO et al

It is certified that error appears in the above-identified patent and that said Letters Patent is hereby corrected as shown below:

Column 32, line 4; delete "pl".

Signed and Sealed this

Twentieth Day of January, 1987

*Attest:*

DONALD J. QUIGG

*Attesting Officer*

*Commissioner of Patents and Trademarks*